US008086132B2

(12) United States Patent
Askren et al.

(10) Patent No.: US 8,086,132 B2
(45) Date of Patent: Dec. 27, 2011

(54) PHOTOCONDUCTOR UNIT WITH CHARGE ROLL WIPER FOR AN IMAGE FORMING DEVICE

(75) Inventors: Benjamin Alan Askren, Lexington, KY (US); Benjamin John Goebel, Lexington, KY (US); Christian Blair Miller, Delaware, OH (US)

(73) Assignee: Lexmark International, Inc., Lexington, KY (US)

( * ) Notice: Subject to any disclaimer, the term of this patent is extended or adjusted under 35 U.S.C. 154(b) by 585 days.

(21) Appl. No.: 12/251,942

(22) Filed: Oct. 15, 2008

(65) Prior Publication Data

US 2010/0092204 A1 Apr. 15, 2010

(51) Int. Cl.
*G03G 15/02* (2006.01)
*G03G 15/08* (2006.01)

(52) U.S. Cl. ..... 399/100; 399/50; 399/71; 399/99; 399/115; 399/279

(58) Field of Classification Search ..... 399/50, 399/71, 99, 100, 115, 176, 279; 361/225
See application file for complete search history.

(56) References Cited

U.S. PATENT DOCUMENTS 5,557,373 A * 9/1996 Miyashita et al. ..... 399/9
5,629,755 A * 5/1997 Ohtsuka ..... 399/176
5,678,136 A * 10/1997 Watanabe et al. ..... 399/100
5,697,020 A * 12/1997 Sato et al. ..... 399/100
5,839,029 A * 11/1998 Kataoka et al. ..... 399/115
5,873,019 A * 2/1999 Mizuishi ..... 399/313
6,298,205 B1 * 10/2001 Chigono et al. ..... 399/174

FOREIGN PATENT DOCUMENTS

JP 05297690 A * 11/1993
JP 06161171 A * 6/1994

* cited by examiner

*Primary Examiner* — David Gray
*Assistant Examiner* — Francis Gray
(74) *Attorney, Agent, or Firm* — John Victor Pezdek

(57) ABSTRACT

A charge roller wiper for photoconductor unit for forming a toner image in an image forming device. The photoconductor unit comprises a photoconductor drum, a charge roller and a first charge roller wiper. The photoconductor drum receives toner particles for forming the toner image that is transferred onto a media sheet. The charge roller charges the photoconductor drum. A first charge roller wiper is disposed substantially parallel to path along which the charge roller moves between a working position and a storage position. The first charge roller wiper is configured to peripherally contact and clean the charge roller when the charge roller assumes a working position. A second charge roller wiper may be provided adjacent the storage position and disposed substantially perpendicular to the first charge roller wiper and directly in the path along which the charge roller moves.

35 Claims, 3 Drawing Sheets

PHOTOCONDUCTOR UNIT WITH CHARGE ROLL WIPER FOR AN IMAGE FORMING DEVICE

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The disclosure relates generally to image forming devices, and, more particularly, to a photoconductor unit for forming an image on a media sheet in an image forming device.

2. Description of the Related Art

Media processing devices, such as printing devices, are typically used to output information displayed on a screen of a data processing device, such as a personal computer. The information may be output on a media sheet, such as a sheet of paper. Printing devices, such as electrophotographic printers, operate by generating an image pattern of information to be printed, and, subsequently transfer toner particles onto a media sheet based on the generated image pattern to produce the image of the information on the media sheet.

An electrophotographic printer typically includes a photoconductor unit for generating the image pattern. The photoconductor unit includes a photoconductor drum and a charge roller. The charge roller is used to charge a surface of the photoconductor drum to a predetermined voltage. A light source, such as a laser diode, may be provided in the electrophotographic printer for emitting a light beam which is pulsed on and off as it is swept across the surface of the photoconductor drum to selectively discharge the surface of the photoconductor drum. A toner unit including a developer roller and a toner medium is provided for developing the image pattern on the surface of the photoconductor drum. Charged toner particles of the toner medium are electrostatically attracted to a surface of the developer roller and are metered into a uniform layer by a metering device such as a doctor blade. As the developer roller rotates, the toner particles on the surface of the developer roller are attracted and move onto the discharged surface areas on the photoconductor drum. In this way, a toned image pattern develops on the surface of the photoconductor drum. The toned image pattern may then be transferred onto a media sheet for forming an image onto the media sheet. A fuser nip may be configured in the electrophotographic printer for receiving the media sheet having the toned image thereon and is used to permanently affix or fuse the toner particles onto the media sheet using heat and or pressure. The media sheet with the affixed toner particles forming the image may then be exited from the electrophotographic printer.

The charge roller of the photoconductor unit may be configured to linearly move, towards and away, from the photoconductor drum for assuming a working position and a storage position, respectively. More specifically, in the working position, the charge roller contacts the photoconductor drum for charging the photoconductor drum. In the storage position, the charge roller linearly retracts away from the photoconductor drum. While transferring the toner particles onto the media sheet, some amount of the toner particles may remain on the surface of the photoconductor drum. These remnant toner particles may adhere onto the charge roller when the charge roller charges the photoconductor drum. The remnant toner particles on the charge roller may result in an uneven charging of the photoconductor drum which can degrade print quality of the image printed on the media sheet.

Further, the photoconductor unit of the media processing device, such as the above-mentioned electrophotographic printer, typically includes a cleaning blade for precluding transfer of the remnant toner particles onto the charge roller from the photoconductor drum. However, these remnant toner particles may adhere to the cleaning blade and wear a portion of the surface of the photoconductor drum. The remnant toner particles may accumulate in that portion of the surface and may further contaminate the charge roller.

To this end, a charge roller wiper adapted to clean a surface of the charge roller may be configured within the photoconductor unit. A photoconductor unit configured with a typical charge roller wiper is depicted in FIG. 1.

Referring now to FIG. 1, a side view of a photoconductor unit 10 including a prior art charge roller wiper arrangement adapted for cleaning a surface of a charge roller 12 is depicted. Charge roller wiper arrangement 10 includes a charge roller wiper 14 which corresponds in length to the length of the charge roller and peripherally contacts charge roller 12. As illustrated charge roller wiper 14 is rectangular in cross section. Charge roller 12 is depicted to be in the working position in FIG. 1. A developer roller 16 of a toner unit (not shown) is further depicted in FIG. 1. Developer roller 16 provides toner particles to a surface of a photoconductor drum 18 for forming an image pattern on the surface. Charge roller wiper 14 is supported on a support bracket 20 and removes remnant toner particles transferred onto charge roller 12 from the surface of photoconductor drum 18. In the storage position, charge roller 12 linearly retracts away from photoconductor drum 18 along line XX', further compressing charge roller wiper 14 in a central region that is also used for wiping charge roller 12. Charge roller wiper 14 slowly decompresses from the compressed state when charge roller 12 assumes the working position.

Typically, a time delay is incurred when charge roller wipers, such as charge roller wiper 14, try to recover from the compressed state to the decompressed state. Height recovery rate, i.e., rate of recovering of a height of a charge roller wiper from a compressed state to a decompressed state is explained in conjunction with FIG. 2.

FIG. 2 depicts variation in height recovery rates of four exemplary charge roller wipers, while recovering from the compressed state to the decompressed state. Plots 22, 24, 26 and 28, depicted in FIG. 2, represent variation in recovery of a height of each of the exemplary four charge roller wipers with respect to time. The recovery of the height of each of the four charge roller wipers is expressed as a percentage of original non-compressed heights of the respective charge roller wipers. The variation in time is expressed in hours. The four charge roller wipers are initially compressed, reducing the height of each of the four charge roller wipers by 1 millimeter (mm) or approximately 25% (typical wipers have a height of about 4.1 mm±0.3 mm) and, placed in an environment having an atmospheric temperature of about 70° C. and a relative humidity of about 50%. Thereafter, the compressed four charge roller wipers may be placed in an environment having an atmospheric temperature of about 22° C. and allowed to attain the decompressed state from the compressed state. Accordingly, plot 22 shows an initial compression of a height of a first charge roller wiper of the four charge roller wipers to about 21% of its original height. Thereafter, on being allowed to attain a decompressed state, the first charge roller wiper attains about 83% of its original height in a time span of 24 hours, as depicted by plot 22.

Similarly, plots 24, 26 and 28 depict an initial compression of heights of a second charge roller wiper, a third charge roller wiper and a fourth charge roller wiper of the four charge roller wipers to about 20%, 21% and 24% of their original heights, respectively. Thereafter, while attaining the decompressed state, the second charge roller wiper, the third charge roller wiper and the fourth charge roller wiper attain about 83%, 82% and 80% of their original heights, respectively, in the time span of 24 hours. Further, as evident from FIG. 2, plots 22, 24, 26 and 28 are logarithmic, i.e., the height recovery of the four charge roller wipers after 24 hours is not as a rapid as the height recovery after the first day. Thus, the four charge roller wipers may not re-attain their original heights during their useable lifetimes due to the moment of the charge roller between its working and storage positions.

The time delay in recovering from the compressed state to the decompressed state, delays cleaning of a charge roller when the charge roller assumes the working position, thereby degrading the cleaning efficiency of the charge roller. Moreover, effective cleaning of the charge roller depends upon factors such as a surface area of contact of the charge roller wiper with the charge roller, a cleaning force applied by the charge roller wiper on the charge roller, and a capacity of the charge roller wiper to retain contamination. Throughout an operating life term of a photoconductor unit, the charge roller wiper may attain the compressed state multiple times thereby leading to a permanent deformation, also known as a plastic deformation, of the charge roller wiper, reducing the contact force of the charge roller wiper on the surface of the charge roller. Moreover, atmospheric conditions such as increased pressure, heat and humidity may accelerate the permanent deformation of the charge roller wiper, thereby reducing the surface area of contact of the charge roller wiper with the charge roller also reducing the cleaning force applied to the charge roller. Thus, effective cleaning of the charge roller by the charge roller wiper may be affected on account of compression of the charge roller wiper, thereby causing print defects, such as vertical and top-to-bottom streaks on a media sheet processed by the media processing device.

Based on the foregoing, there is a need for effectively cleaning a charge roller in an image forming device. Further, there exists a need for precluding a time delay in cleaning of a charge roller on assuming the working position by the charge roller. Furthermore, there exists a need for effectively cleaning a charge roller for precluding development of vertical and top-to-bottom streaks on a media sheet processed by the media processing device.

SUMMARY OF THE INVENTION

In one illustrative embodiment, a photoconductor unit for forming an image on a media sheet in an image forming device comprises a photoconductor drum, a charge roller and a first charge roller wiper. The photoconductor drum receives toner particles for forming the image on the media sheet. The charge roller charges the photoconductor drum. Further, the charge roller moves along a path between a working position and a storage position. In the working position, the charge roller contacts the photoconductor drum, charging the photoconductor drum. The first charge roller wiper is disposed substantially parallel to the path along which the charge roller moves. The first charge roller wiper peripherally contacts the charge roller cleaning the charge roller in a first position when the charge roller assumes the working position. When the charge roller is in the storage position, the charge roller wiper may either contact the charge roller at a second position or may be positioned such that it does not contact the charge roller.

In another aspect, a cartridge for an image forming device comprises a photoconductor unit for printing information onto media sheets. The toner unit may also be provided which stores a toner medium used for forming an image on the media sheet. The photoconductor unit may be operatively coupled with the toner unit. The photoconductor unit comprises a photoconductor drum, a charge roller and a first charge roller wiper. The photoconductor drum receives toner particles for forming the image on the media sheet. The charge roller charges the photoconductor drum. Further, the charge roller moves along a path between a working position and a storage position. In the working position, the charge roller contacts the photoconductor drum, charging the photoconductor drum. The first charge roller wiper is disposed substantially parallel to the path along which the charge roller moves. The first charge roller wiper peripherally contacts the charge roller in a first position cleaning the charge roller when the charge roller assumes the working position. When the charge roller is in the storage position, the charge roller wiper may either contact the charge roller at a second position or may be positioned such that it does not contact the charge roller.

Providing the first charge roller wiper substantially parallel to the path along which the charge roller moves between the working position and storage position reduces compression of the first charge roller wiper when the charge roller is in the storage position. Further the first charge roller wiper may regain a decompressed state from the compressed state without incurring the time delay, thereby more effectively cleaning the charge roller.

In another illustrative embodiment, a second charge roller wiper is provided in addition to the first charge roller wiper. The second charge roller wiper is disposed 10 substantially perpendicular to the first charge roll wiper and directly in the path along which the charge roller moves, and, peripherally contacts the surface of the charge roller when in the working position and storage position. With the charge roller in the working position, the first charge roller wiper cleans the charge roller while the second charge roller wiper is returning from a compressed state to a decompressed state. On returning to the decompressed state, the second charge roller wiper 15 provides additional cleaning of the charge roller. Moreover, an occurrence of time delay for cleaning the charge roller on assuming the working position is precluded due to the use of the first charge roller wiper. The cleaning of the charge roller prevents contamination of the charge roller, thereby precluding a development of vertical and top-to-bottom streaks on a media sheet processed by the media processing device.

BRIEF DESCRIPTION OF THE DRAWINGS

The above-mentioned and other features and advantages of this present disclosure, and the manner of attaining them, will become more apparent and the present disclosure will be better understood by reference to the following description of embodiments of the disclosure taken in conjunction with the accompanying drawings, wherein.

DETAILED DESCRIPTION

Figure 1:
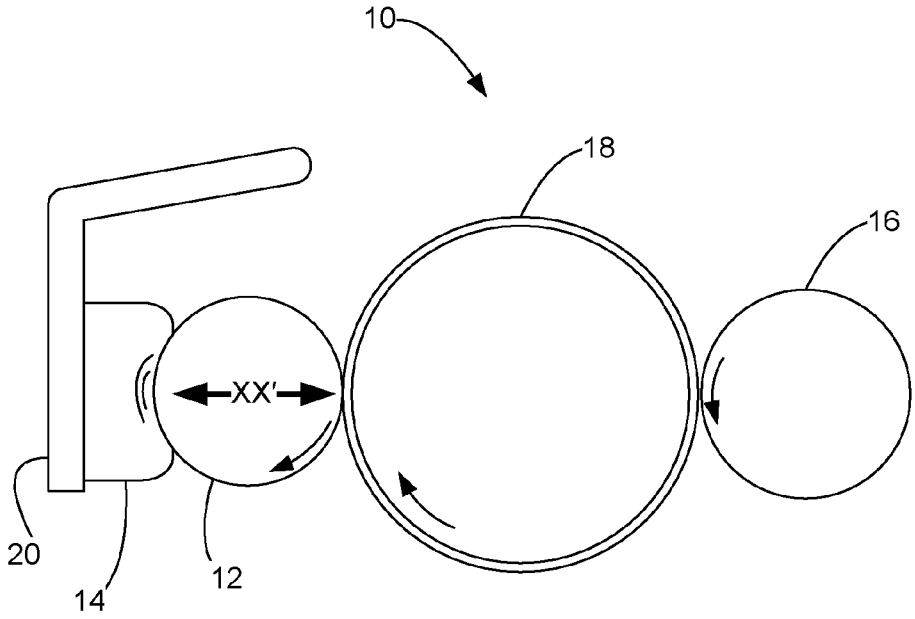
FIG. 1 (Prior Art)
FIG. 1 is a schematic depiction of a side view of a photoconductor unit including a charge roller wiper of the prior art adapted for cleaning a surface of a charge roller.
Figure 2:
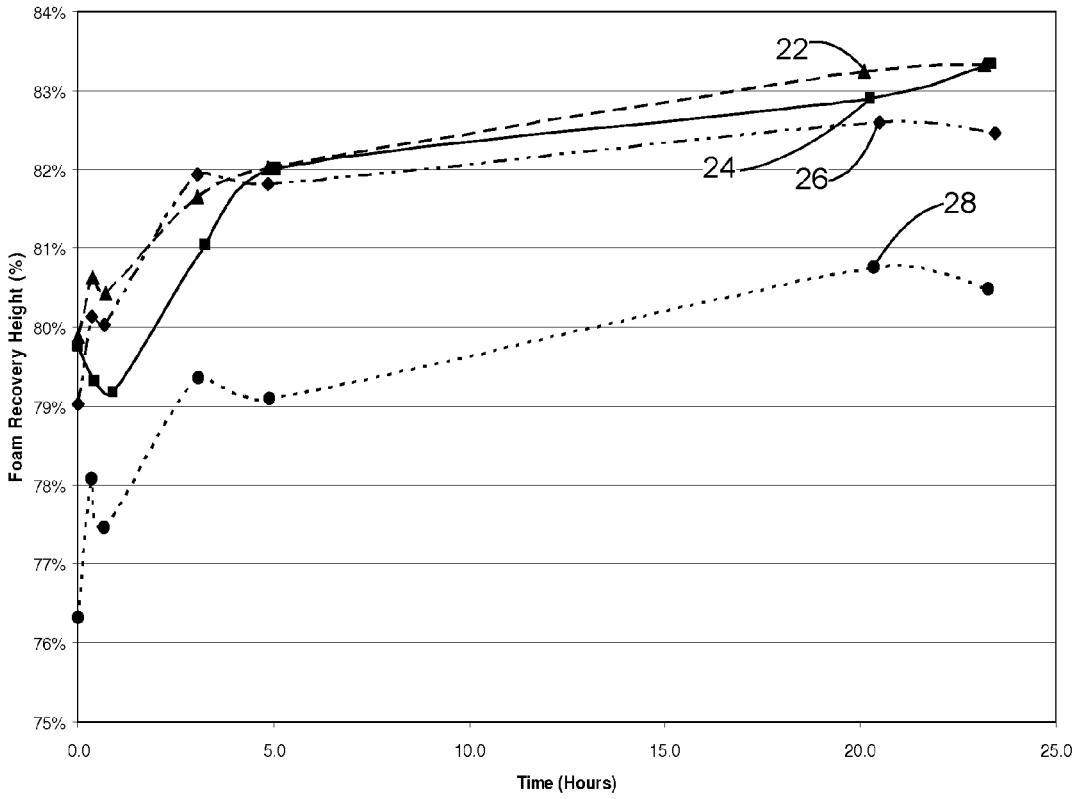
FIG. 2 is a schematic depiction of variation in height recovery rates of four exemplary charge roller wipers of the prior art while recovering from a compressed state to a decompressed state.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including", "comprising" or "having" and variations thereof herein is meant to encompass the items listed thereafter and equivalents thereof as well as additional items. Unless limited otherwise, the term "coupled" and variations thereof herein are used broadly and encompass direct and indirect couplings. In addition, the term "coupled" and variations thereof are not restricted to physical or mechanical couplings. In the figures, like elements will use like reference numerals.

A photoconductor unit for forming an image on a media sheet in an image forming device comprises a photoconductor drum, a charge roller and a first charge roller wiper. The photoconductor drum receives toner particles for forming the image on the media sheet. The charge roller charges the photoconductor drum. Further, the charge roller moves along a path between one of a working position and a storage position. This path may be linear or it move along a curved path. In the working position, the charge roller contacts the photoconductor drum charging the photoconductor drum. The first charge roller wiper is disposed substantially parallel to the path along which the charge roller moves. The first charge roller wiper peripherally contacts the charge roller at a first position cleaning the charge roller when the charge roller assumes the working position where it rotates against the surface of the photoconductor drum. When the charge roller is in the storage position, the charge roller wiper may either contact the charge roller at a second position or may be positioned such that it does not contact the charge roller.

Figure 3:
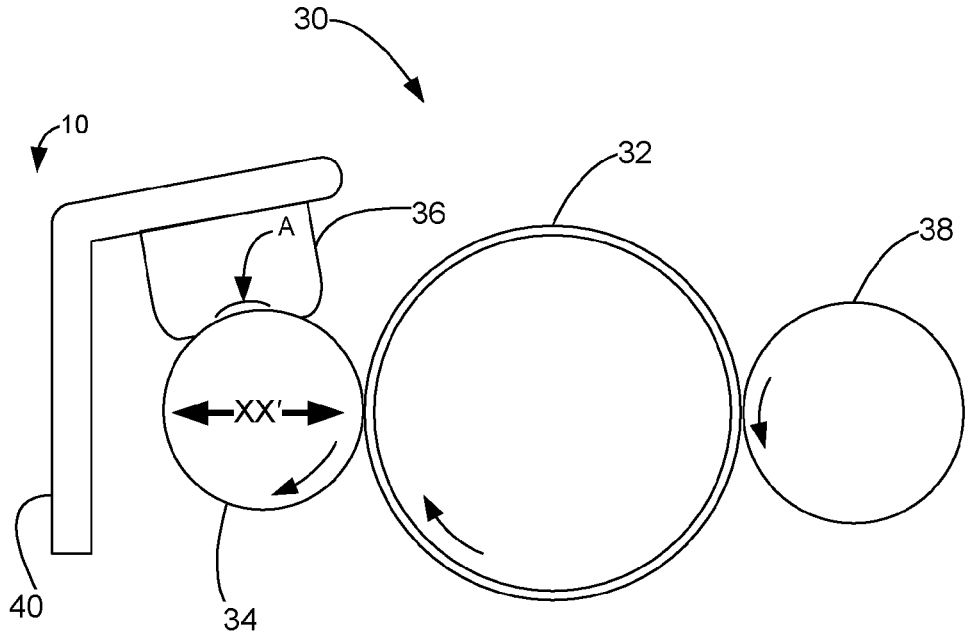
FIG. 3 is a schematic depiction of a side view of a photoconductor unit including a first charge roller wiper disposed substantially parallel to the path along which the charge roller moves.

Referring now to FIG. 3, a side view of a photoconductor unit 30 of an image forming device is depicted. An example of an image forming device may be an electrophotographic printer. Photoconductor unit 30 may also be removably insertable into an image forming device or be part of a toner cartridge. Photoconductor unit 30 includes a photoconductor drum 32, a charge roller 34 shown in the working position and a first charge roller wiper 36. The image forming device includes a toner unit (not shown). The toner unit includes a developer roller 38, abuttingly coupled to photoconductor drum 32. The toner unit stores a toner medium used for forming an image on a media sheet. Photoconductor unit 30 is operatively coupled to the toner unit. Photoconductor drum 32 receives toner particles of the toner medium from developer roller 38 of the toner unit for forming an image pattern on a surface of photoconductor drum 32.

Charge roller 34 moves along a path between a working position and a storage position. The path is shown to be linear along a line that would extend through the centers of charge roller 34 and photoconductor drum 32, but other path configurations may also be used. In the working position (depicted in FIG. 3), charge roller 34 contacts photoconductor drum 32 peripherally for charging photoconductor drum 32. In the storage position (depicted in FIG. 5), charge roller 34 retracts away from photoconductor drum 32. Typically, in the storage position charge roller 34 is restrained by means not shown from contacting the surface of photoconductor drum 32 due to a tendency of charge roller 34 to leach oils which may damage photoconductor drum 32. Further, a material, such as a conductive rubber, that comprises charge roller 34 may be incompatible with photoconductor drum 32 under high heat and humidity conditions. Thus, charge roller 34 is retracted from photoconductor drum 32 when not in an operating condition or when packaged as to be shipped or stored for long periods. Charge roller 34 may be retracted from photoconductor drum 32 using a shipping separator or any such other apparatus.

Photoconductor drum 32 and charge roller 34 angularly rotate for uniform charging of photoconductor drum 32. As shown charge roller 34 rotates due to the frictional force between it and photoconductor drum 32. Charge roller 34 may also be configured to be driven by other means other than photoconductor drum 32. Developer roller 38 angularly rotates in a direction opposite to a direction of the angular rotation of photoconductor drum 32 for transferring toner particles to the surface of photoconductor drum 32.

A light source such as a laser diode (see FIG. 6) in the image forming device emits a light beam which is pulsed on and off as it is swept across the surface of photoconductor drum 32 to selectively discharge the surface, thereby forming an exposure pattern, also called a latent image, on the surface of photoconductor drum 32. The charge pattern corresponds to information that is to be printed on the media sheet. The toner particles from developer roller 38 are transferred from developer roller 38 onto the exposure pattern formed on the surface, thereby forming a toned image pattern on the surface of photoconductor drum 32. The toned image pattern is subsequently transferred from the surface of photoconductor drum 32 onto a media sheet (not shown) for forming an image on the media sheet.

Some of the toner particles may remain on the surface of photoconductor drum 32 subsequent to the transfer of toner particles from the surface of photoconductor drum 32 onto the media sheet. These remaining toner particles, hereinafter referred to as remnant toner particles, may adhere to charge roller 34, more specifically to a surface of charge roller 34, when charge roller 34 contacts photoconductor drum 32 in its working position, thereby contaminating charge roller 34.

Accordingly, first charge roller wiper 36 is disposed substantially parallel to the path along which charge roller 34 moves between the working position and storage position. First charge roller wiper 36 may be supported on a support structure, such as support bracket 40, such that first charge roller wiper 36 contacts charge roller 34 at a first position A when charge roller 34 is in the working position for cleaning charge roller 34. Although first charge roller wiper 36 is disposed substantially parallel to the path along which charge roller 34 moves, various possible inclination angles of first charge roller wiper 36 may be contemplated for peripherally contacting charge roller 34 when charge roller wiper 36 assumes the working position. Further while bracket 40 is depicted to be L-shaped in FIG. 3, various shapes of support bracket 40, such as a U-Shape or a C-shape may be configured for supporting first charge roller wiper 36. Moreover, at first position A, first charge roller wiper 36 cleans the surface of charge roller 34 by removing the remnant toner particles from the surface of charge roller 34. First charge roller wiper 36, slightly compressed in the region at position A by charge roller 34 when in the working position, mechanically wipes the surface of charge roller 34 and retains the remnant toner particles wiped from the surface of charge roller 34.

Figure 5:
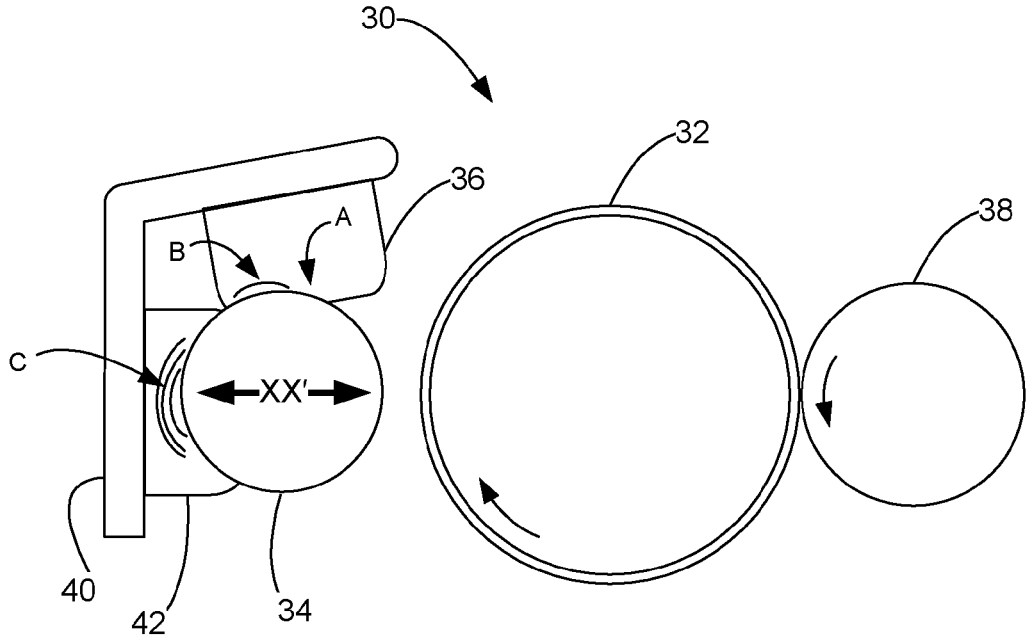
FIG. 5 is a schematic depiction of the charge roller in a storage position illustrating the difference in the amount of compression between the first and second charge roller wipers.

In the region about a second position B, first charge roller wiper 36 disposed in such position precludes substantial compression of a height of first charge roller wiper 36 when charge roller 34 retracts away from photoconductor drum 32 and assumes the storage position. The compression of the height of first charge roller wiper 36 when charge roller 34 assumes the storage position is depicted in FIG. 5. In the region about position B, only a small portion of first charge roller wiper 36 is compressed by charge roller 34 in the storage position. In the region about position A, the first charge roller wiper 36 regains a decompressed state from a compressed state with minimal or no time delay, when charge roller 34 moves from the working position to the storage position. Because first charge roller wiper 36 regains a decompressed state with a minimal or no delay, cleaning of charge roller 34 is achieved as soon as charge roller 34 assumes the working position. It will be realized that when charge roller 34 is in the storage position, the region about position B of charge roller wiper 36 may be angled so that there is no contact with charge roller 34 and the charge roller is adjacent to this region of charge roller wiper 136.

Figure 4:
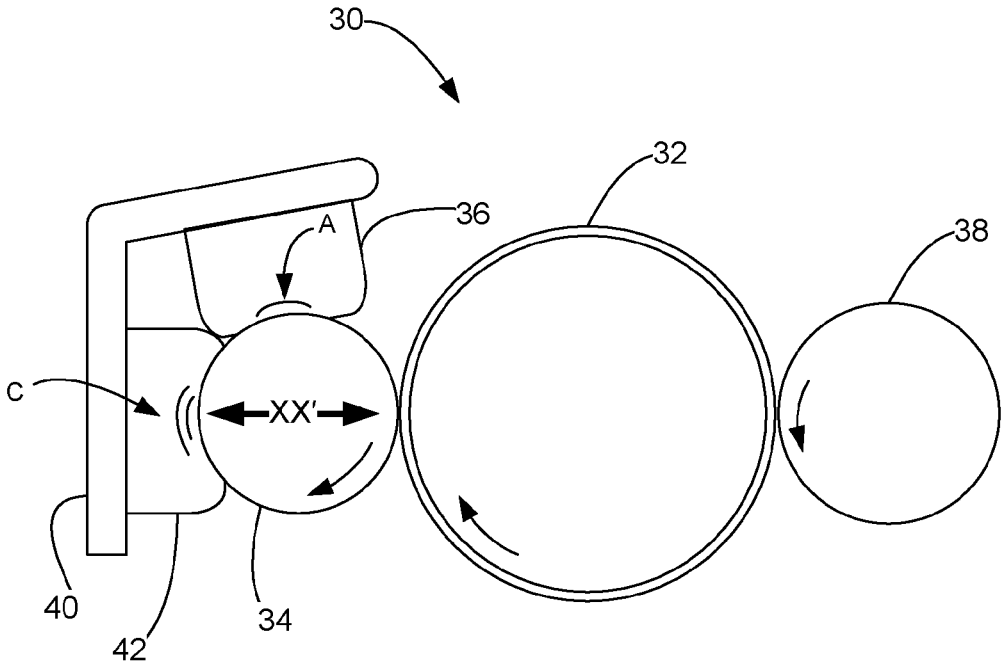
FIG. 4 is a schematic depiction of a side view of the photoconductor unit including the first charge roller wiper and a second charge roller wiper disposed substantially perpendicular to the path along which the charge roller moves.

FIG. 4 is a schematic depiction of a side view of photoconductor unit 30 including first charge roller wiper 36, and, a second charge roller wiper 42 disposed substantially perpendicular to the first charge roller wiper 36 and directly in the path along which charge roller 34 moves. Second charge roller wiper 42 is supported by support bracket 40, such that, second charge roller wiper 42 peripherally contacts charge roller 34 and cleans charge roller 34 when charge roller 34 is in the working position as shown. In the central region at position C, second charge roller wiper 42 is less compressed than as compared to when charge roller 34 is in its storage position as shown in FIG. 5. Second charge roller wiper 42 cleans the surface of charge roller 34 by removing the remnant toner particles from the surface of charge roller 34. For this illustrative embodiment, it should be understood that charge roller 34 is not rotated when it is in the storage position but if it is, both charge roller wipers 36 and 42 would provide surface cleaning on charge roller 34.

Second charge roller wiper 42 is positioned adjacent to the storage position of charge roller 34 and disposed substantially perpendicular to the first charge roll wiper 36 and directly in the path along which charge roller 34 moves. As a result, at a least a portion, e.g., the central region at C, of second charge roller wiper 42 is more compressed (as illustrated by compression lines at C in FIG. 5) as compared to first charge roller wiper 36 when charge roller 34 assumes the storage position. Because of this compression of the at least a portion of the second charge roller wiper 42 by charge roller 34 in storage position of charge roller 34; second charge roller wiper 42 incurs a time delay to regain the decompressed state from the compressed state.

With charge roller 34 in the working position, first charge roller wiper 36 cleans charge roller 34 while second charge roller wiper 42 regains its original uncompressed state. On regaining a substantial portion of its height after a time delay, i.e., the decompressed state, second charge roller wiper 42 may then assist in cleaning charge roller 34. As a result, effective cleaning of charge roller 34 is performed throughout operation of charge roller 34 in the working position.

Each of first charge roller wiper 36 and second charge roller wiper 42 may be composed of at least one of a polyether-urethane foam material and a polyester-urethane foam material. However, first charge roller wiper 36 and second charge roller wiper 42 may be composed of any such other material known in the art for facilitating effective cleaning of charge roller 34.

FIG. 5 is a schematic depiction of charge roller 34 in the storage position compressing first charge roller wiper 36 and second charge roller wiper 42. As explained in conjunction with FIGS. 3 and 4, charge roller 34 retracts away from photoconductor drum 32 for assuming its storage position. As can be seen from FIG. 5, at position B only a small region or portion of first charge roller wiper 36 is compressed by charge roller 34 in storage position, whereas, a substantial central region at position C of second charge roller wiper 42 is compressed. Compression lines at B and C illustrate the relative difference in compression of first and second charge roller wipers 36 and 42, respectively. For second charge roller wiper 42 the central region in which this compression occurs is also the primary region that is also used for cleaning charge roller 34 when it is in its working position. This is contrasted with a second region at B in which first charge roller wiper 36 is compressed during charge roller 34 storage where the compression occurs outside of the first more central region of first charge roller wiper 36 and to a lesser degree. It will be appreciated that when charge roller 34 is in the working position, it will contact and compress the surface of first charge roller wiper 36 in a first region that is located nearer to the center or front edge of first charge roller wiper 36 as opposed to second charge roller wiper 42.

Charge roller 34 may be retracted from photoconductor drum 32 using a shipping separator (not shown). The shipping separator may be operatively coupled to charge roller 34 and photoconductor drum 32. The shipping separator may be capable of positioning charge roller 34 to contact photoconductor drum 32 during the working position and retracting charge roller 34 from photoconductor drum 32 during the storage position. A motor-driven retracting arrangement or such mechanical configuration known in the art, for positioning charge roller 34 in the working position and the storage position may also be used.

First charge roller wiper 36 and/or second charge roller wiper 42 maintain tangential friction with charge roller 34. The tangential friction may be utilized by first charge roller wiper 36 and second charge roller wiper 42 to entrap the remnant toner particles and other contaminants such as, dust present on the surface of charge roller 34.

Using charge roller wipers such as first charge roller wiper 36 and/or second charge roller wiper 42 explained in conjunction with FIGS. 4 and 5, effective cleaning of charge roller, such as charge roller 34, is achieved in an image forming device. Moreover, an occurrence of time delay for cleaning the charge roller on assuming the working position is precluded. Effective cleaning of the charge roller precludes contamination of the charge roller, thereby precluding a development of vertical and top-to-bottom streaks on a media sheet processed by the media processing device, improving a quality of image printed on the media sheet.

In testing, it was found that with charge roller 34 driven by the photoconductor drum 32 and not independently driven, using two charge roller wipers such as first charge roller wiper 36 and second charge roller wiper 42, at least 20,000 media sheets were printed without any observable defect such as contamination streaks. In contrast forming images on media sheets using first charge roller wiper 36 alone defects were observed within printing of 6000 media sheets, and, when using charge roller wiper 42 alone, contamination defects were observed within printing of 8000 media sheets by the image forming device. Thus, for a charge roller that is driven by the photoconductor drum, using charge roller wipers such as first charge roller wiper 36 in combination with second charge roller wiper 42 provides sustained cleaning of the charge roller over a longer period.

The lower number of printed media sheets (i.e., 6000 sheets) before the print defects were observed when using only charge roller wiper 36 is due to angle at which the compressive force of charge roller wiper 36 is applied to the charge roller 34 which caused charge roller 34 to move out of contact with photoconductor drum 32. It is expected that if charge roller 34 were independently driven when in the working position (as opposed to being driven by photoconductor drum 32) or if the angle at which the force is applied by charge roller wiper 36 changed so that the charge roller 34 does not move away from photoconductive drum 32, higher compressive force could then be used when using only charge roller wiper 36 providing more effective cleaning allowing for a higher number of media sheets to be printed than would occur as compared to use of charge roller wiper 42 alone. Again with an independently driven charge roller configuration, charge roller 34 would continue to be moved away from the photoconductor drum 32 to the storage position for the reasons previously given and its contact with charge roller wiper 36 would be at a region different than when the charge roller 34 is in the working position.

Figure 6:
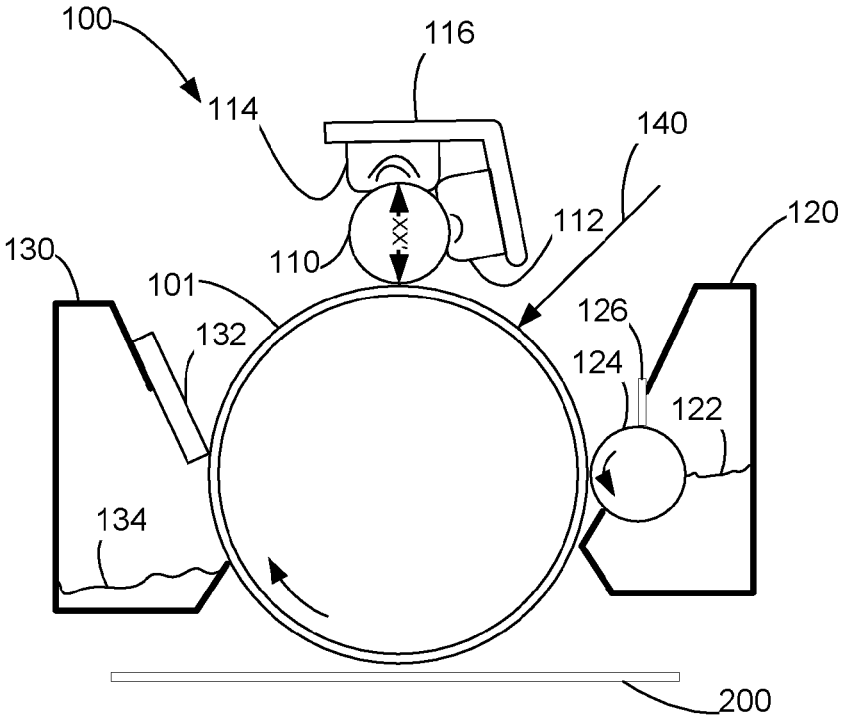
FIG. 6 is a schematic illustration of a photoconductor in conjunction with a developing unit, cleaning unit, charging roller, etc according to one or more embodiments of the present invention.

The charge roller and photoconductive drum together with the first and or second charge roller wipers may be utilized in various toner cartridges and or printer configurations familiar to one of ordinary skill in the art. One such configuration is illustrated in FIG. 6. The image forming device 100 (e.g., a printer) may comprise a photoconductive drum 101, a charge roller 110, first charge roller wiper 112 and or second charge roller wiper 114, support 116, developer unit 120 and a cleaner unit 130. The charge roller 110 negatively charges the surface of the photoconductive drum 101. The charged surface of the photoconductive drum 101 may then be irradiated by a laser light source 140 to form an electrostatic latent image on the photoconductive drum 101 corresponding to an image. The developing unit 120 may include a toner sump 122, a developer roller 124 and a toner metering device 126. Toner in the sump 122 is transferred to the surface of developer roll 124 by various means including a toner transfer roller (not shown). The toner metering device 126 such as a doctor blade serves as a means of providing a uniform layer of toner on the developer roller 124. The developer roller 124 and doctor blade 126 can be charged which in turn charges the toner. The charged toner is attached to the latent image on the photoconductor drum 101. The toned image from the photoconductive drum 101 may be transferred directly to a recording medium, (e.g., paper 200) or may utilize an intermediate transfer belt (not shown) to transfer the image to the paper 200. A fusing unit (not shown) is used to fuse the toner image to the paper 200. A cleaning unit 130 uses a cleaning blade 132 to scrape off any residual toner still adhering to the photoconductive drum 101 after the image is transferred to the paper 200. First and second charge roller wipers 112, 114 are used to remove any remaining toner remnants that may find their way to charge roller 110. The cleaned surface of the photoconductive drum 101 can now be charged again, repeating the imaging and printing cycle. The waste toner 134 is held in a waste toner sump in the cleaning unit 130. Alternatively the charge roller 110 and photoconductive drum 101 together with the first and/or second charge roller wipers 112 and 114 may be incorporated in the housing of a toner cartridge which is removably insertable in the image forming device 100.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A photoconductor unit for forming an image on a media sheet in an image forming device, the photoconductor unit comprising:

a photoconductor drum for receiving toner particles for forming a toned image;

a charge roller for charging the photoconductor drum, the charge roller moveable along a path between one of a working position and a storage position, wherein the charge roller in the working position contacts the photoconductor drum for charging the photoconductor drum; and a first charge roller wiper disposed substantially parallel to a path along which the charge roller moves, the first charge roller wiper peripherally contacting and cleaning the charge roller when the charge roller is in the working position.

2. The photoconductor unit of claim 1, wherein the charge roller retracts from the photoconductor drum when in the storage position.

3. The photoconductor unit of claim 1, wherein the charge roller in the working position contacts the first charge roller wiper in a first region and contacts the first charge roller wiper in a second region thereof when in the storage position.

4. The photoconductor unit of claim 1, wherein the charge roller in the working position contacts the first charge roller wiper in a first region and in the storage position is adjacent to but separated from contact with the first charge roller wiper in a second region thereof.

5. The photoconductor unit of claim 1, further comprising a second charge roller wiper disposed substantially perpendicular to the first charge roller wiper and directly in the path along which the charge roller moves, the second charge roller wiper peripherally contacts the charge roller in a central region, the second charge roller wiper cleaning the charge roller after the charge roller assumes the working position.

6. The photoconductor unit of claim 5, wherein the charge roller on assuming the storage position compresses the central region of the second charge roller wiper.

7. The photoconductor unit of claim 5, wherein with the charge roller in the working position the first charge roller wiper cleans the charge roller while the central region of the second charge roller wiper attains a decompressed state.

8. The photoconductor unit of claim 1, wherein the first charge roller wiper is composed of at least one of a polyether-urethane foam material and a polyester-urethane foam material.

9. The photoconductor unit of claim 5 wherein the second charge roller wiper is composed of at least one of a polyether-urethane foam material and a polyester-urethane foam material.

10. A cartridge for an image forming device, comprising:

a photoconductor unit comprising:

a photoconductor drum for receiving toner particles for forming a toned image thereon;

a charge roller for charging the photoconductor drum, the charge roller moving on a path between one of a working position and a storage position, wherein the charge roller in the working position contacts the photoconductor drum for charging the photoconductor drum; and a first charge roller wiper disposed substantially parallel to the path along which the charge roller moves, the first charge roller wiper peripherally contacting and cleaning the charge roller of toner particles when the charge roller assumes the working position.

11. The cartridge of claim 10 further comprising a toner unit for storing the toner particles, the toner unit operatively coupled to the photoconductor unit for providing the toner particles to the photoconductor unit.

12. The cartridge of claim 10, wherein the charge roller retracts from the photoconductor drum when in the storage position.

13. The cartridge of claim 10, wherein the charge roller in the working position contacts the first charge roller wiper in a first region thereof and when in the storage position contacts the first charge roller wiper in a second region thereof.

14. The cartridge of claim 10, wherein the charge roller in the working position contacts the first charge roller wiper in a first region and in the storage position is adjacent to but separated from contact with the first charge roller wiper in a second region thereof.

15. The cartridge of claim 10, further comprising a second charge roller wiper positioned adjacent to the storage position and substantially perpendicular to the first charge roller wiper and directly in the path along which the charge roller moves, the second charge roller wiper having a central region contacting the charge roller, the second charge roller wiper cleaning the charge roller after the charge roller assumes the working position.

16. The cartridge of claim 10, wherein the charge roller on assuming the storage position compresses the central region of the second charge roller wiper.

17. The cartridge of claim 10, wherein with the charge roller in the working position the first charge roller wiper cleans the charge roller while the central region of the second charge roller wiper attains a decompressed state.

18. The cartridge of claim 10, wherein the first charge roller wiper is composed of at least one of a polyether-urethane foam material and a polyester-urethane foam material.

19. The cartridge of claim 15 wherein the second charge roller wiper is composed of at least one of a polyether-urethane foam material and a polyester-urethane foam material.

20. The photoconductor unit of claim 3, further comprising a second charge roller wiper disposed perpendicular to the first charge roller wiper and directly in the path along which the charge roller moves, the second charge roller wiper peripherally contacts the charge roller in a central region, the second charge roller wiper cleaning the charge roller after the charge roller assumes the working position.

21. The photoconductor unit of claim 20, wherein the charge roller on assuming the storage position compresses the central region of the second charge roller wiper.

22. The photoconductor unit of claim 20, wherein with the charge roller in the working position the first charge roller wiper cleans the charge roller while the central region of the second charge roller wiper attains a decompressed state.

23. The photoconductor unit of claim 20, wherein the first charge roller wiper is composed of at least one of a polyether-urethane foam material and a polyester-urethane foam material and the second charge roller wiper is composed of at least one of a polyether-urethane foam material and a polyester-urethane foam material.

24. The photoconductor unit of claim 4, further comprising a second charge roller wiper disposed perpendicular to the first charge roller wiper and directly in the path along which the charge roller moves, the second charge roller wiper peripherally contacts the charge roller in a central region, the second charge roller wiper cleaning the charge roller after the charge roller assumes the working position.

25. The photoconductor unit of claim 24, wherein the charge roller on assuming the storage position compresses the central region of the second charge roller wiper.

26. The photoconductor unit of claim 24, wherein with the charge roller in the working position the first charge roller wiper cleans the charge roller while the central region of the second charge roller wiper attains a decompressed state.

27. The photoconductor unit of claim 24, wherein the first charge roller wiper is composed of at least one of a polyether-urethane foam material and a polyester-urethane foam material and the second charge roller wiper is composed of at least one of a polyether-urethane foam material and a polyester-urethane foam material.

28. The cartridge of claim 13, further comprising a second charge roller wiper disposed perpendicular to the first charge roller wiper and directly in the path along which the charge roller moves, the second charge roller wiper peripherally contacts the charge roller in a central region, the second charge roller wiper cleaning the charge roller after the charge roller assumes the working position.

29. The cartridge of claim 28, wherein the charge roller on assuming the storage position compresses the central region of the second charge roller wiper.

30. The cartridge of claim 28, wherein with the charge roller in the working position the first charge roller wiper cleans the charge roller while the central region of the second charge roller wiper attains a decompressed state.

31. The cartridge of claim 28, wherein the first charge roller wiper is composed of at least one of a polyether-urethane foam material and a polyester-urethane foam material and the second charge roller wiper is composed of at least one of a polyether-urethane foam material and a polyester-urethane foam material.

32. The cartridge of claim 14, further comprising a second charge roller wiper disposed perpendicular to the first charge roller wiper and directly in the path along which the charge roller moves, the second charge roller wiper peripherally contacts the charge roller in a central region, the second charge roller wiper cleaning the charge roller after the charge roller assumes the working position.

33. The cartridge of claim 32, wherein the charge roller on assuming the storage position compresses the central region of the second charge roller wiper.

34. The cartridge of claim 32, wherein with the charge roller in the working position the first charge roller wiper cleans the charge roller while the central region of the second charge roller wiper attains a decompressed state.

35. The cartridge of claim 32, wherein the first charge roller wiper is composed of at least one of a polyether-urethane foam material and a polyester-urethane foam material and the second charge roller wiper is composed of at least one of a polyether-urethane foam material and a polyester-urethane foam material.

* * * * *